US010993007B1

(12) United States Patent
Leigh

(10) Patent No.: US 10,993,007 B1
(45) Date of Patent: Apr. 27, 2021

(54) PORTABLE DISC JOCKEY SOUND SYSTEM

(71) Applicant: Dwayne L. Leigh, Myrtle Beach, SC (US)

(72) Inventor: Dwayne L. Leigh, Myrtle Beach, SC (US)

( * ) Notice: Subject to any disclaimer, the term of this patent is extended or adjusted under 35 U.S.C. 154(b) by 0 days.

(21) Appl. No.: 16/728,475

(22) Filed: Dec. 27, 2019

(51) Int. Cl.
*H04R 1/02* (2006.01)
*H04R 3/14* (2006.01)
*H04R 1/08* (2006.01)

(52) U.S. Cl.
CPC ..... *H04R 1/025* (2013.01); *H04R 1/08* (2013.01); *H04R 3/14* (2013.01); *H04R 2201/028* (2013.01)

(58) Field of Classification Search
CPC . H04R 1/025; H04R 1/08; H04R 3/14; H04R 2201/028
See application file for complete search history.

(56) References Cited

U.S. PATENT DOCUMENTS 8,311,256 B1 * 11/2012 Strauser ..... H04R 1/026 381/365
D837,283 S 1/2019 Tsai
2006/0221776 A1 10/2006 Roman et al.
2007/0280489 A1 12/2007 Roman et al.
2009/0139941 A1 * 6/2009 Saghian ..... G06F 1/1628 211/26
2010/0096959 A1 * 4/2010 Weaver ..... E05B 65/46 312/109
2011/0247528 A1 * 10/2011 Walker ..... A63F 13/02 108/42
2016/0050494 A1 2/2016 McCorkle et al.
2016/0088757 A1 * 3/2016 Aldridge ..... H05K 7/10 361/724
2016/0322039 A1 * 11/2016 Siciliano ..... G10H 1/0008
2018/0265109 A1 * 9/2018 Grappe ..... B62B 3/02
2018/0277079 A1 9/2018 Wilson, Jr.
2018/0332956 A1 * 11/2018 Pappas ..... A47B 19/00

* cited by examiner

*Primary Examiner* — Andrew L Sniezek

(57) ABSTRACT

A portable disc jockey sound system is an apparatus that houses and stores in disc jockey (DJ) equipment in a safe and organized manner. The apparatus includes a pedestal, a table, a base, a portable computing device, a power source, and a sound system. The pedestal uplifts the table from the ground so that a user may engage the sound system with the portable computing device while standing. The table supports and presents the portable computing device and a variety of DJing equipment for the user so that the user may readily access the portable computing device and DJing equipment. The base balances the platform with the ground. The portable computing device controls the sound of the music emitted with the sound system. The power source provides the necessary power for the portable computing device, the sound system, and a variety of other electronic devices connected with the apparatus.

11 Claims, 9 Drawing Sheets

PORTABLE DISC JOCKEY SOUND SYSTEM

FIELD OF THE INVENTION

The present invention generally relates to disc jockey equipment. More specifically, the present invention is a portable disc jockey sound system.

BACKGROUND OF THE INVENTION

Traditional disc jockey (DJ) equipment are large in size and require a great amount of time and space to set up. DJ equipment are also expensive and easily damaged throughout transportation without proper storage. Taking the time to load and unload expensive DJ equipment cuts into the time a DJ may use elsewhere preparing for an event. Furthermore, events that typically require a DJ are held at venues with strict cleanup times that require the DJ to quickly pack up and leave the venue.

It is therefore an objective of the present invention to facilitate the setup and cleanup for a DJ. The present invention is a portable disc jockey sound system that secures DJ equipment throughout transportation and use. Furthermore, the present invention presents the DJ equipment to a user in an organized manner. The present invention allows a user to accommodate a variety of settings and venues by housing any and all DJ equipment necessary to provide a continuously entertaining performance throughout the entire event.

DETAIL DESCRIPTIONS OF THE INVENTION

Figure 1:
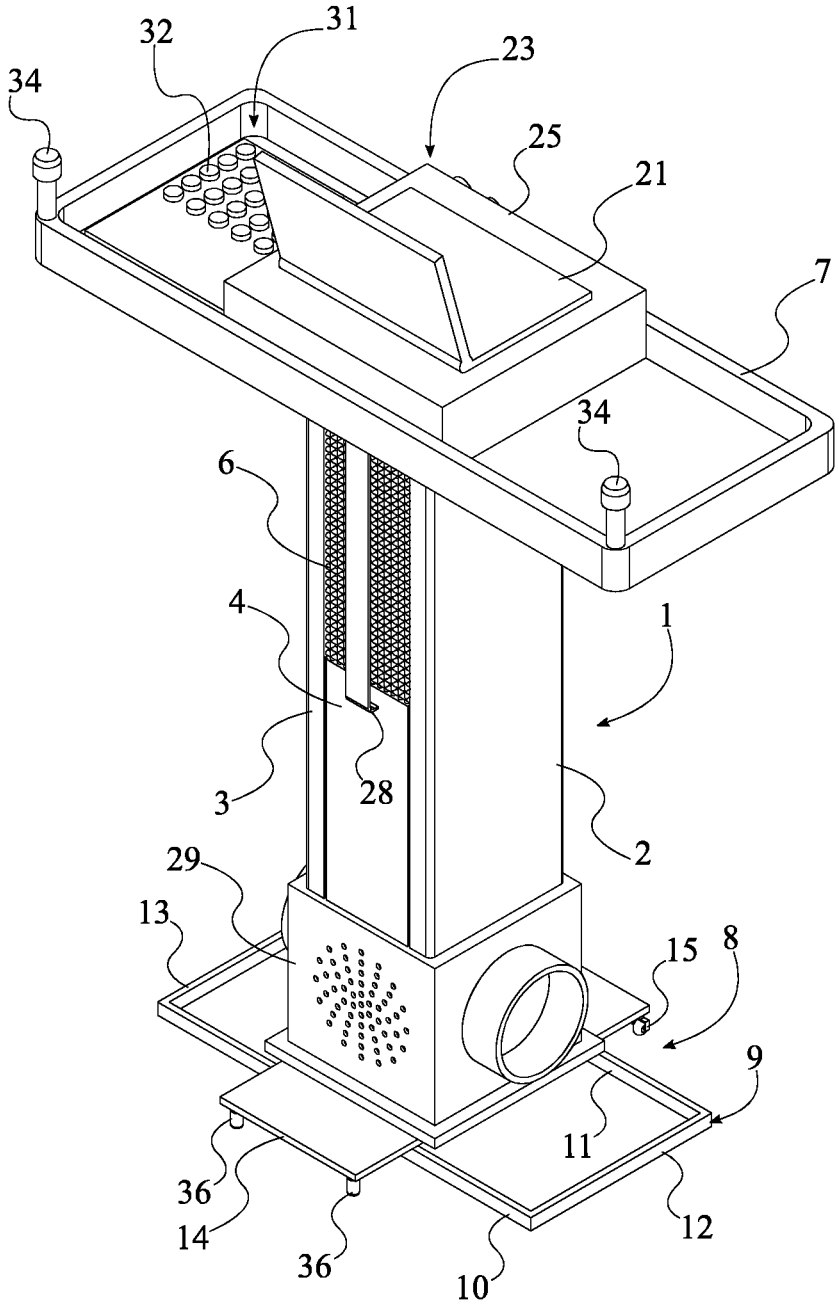
FIG. 1 is a front perspective view of a first embodiment of the present invention.

All illustrations of the drawings are for the purpose of describing selected versions of the present invention and are not intended to limit the scope of the present invention.

The present invention is a portable disc jockey sound system that safely houses disc jockey (DJ) equipment for transport and effectively organizes DJ equipment so that a user may easily access devices. The present invention allows a DJ to set up at a variety of events and venues with minimal effort. The present invention also visually enhances the DJ equipment for individuals nearby as the present invention stores any cord or wire connections out of sight, creating a clean and professional presentation. In order for the present invention to be easily maneuverable while effectively maintaining the organization of DJ equipment stored with the present invention, the present invention comprises a pedestal 1, a table 7, a base 8, a portable computing device 21, a power source 22, and a sound system 23, seen in FIG. 1, FIG. 4, FIG. 6, FIG. 7, FIG. 8, and FIG. 9. The pedestal 1 houses electrical connections and a variety of electronic devices that are not actively used by the user while DJing. The pedestal 1 also upholds the table 7 which in turn upholds a variety of electronic devices that are operated by the user throughout a performance. In order for the pedestal 1 to effectively conceal electronic connections and electronic devices, the pedestal 1 comprises a first elongated casing 2, a second elongated casing 3, a cover 4, and a door 5. The first elongated casing 2 and the second elongated casing 3 structurally supports the table 7 while surrounding allowing a variety of electronic devices to be mounted within the pedestal 1. The first elongated casing 2, the second elongated casing 3, the cover 4, and the door 5 altogether surround and house electronic connections and electronic devices. The door 5 allows the electronic connections and devices to be accessed by the user. The base 8 supports and uplifts the pedestal 1 from the ground and allows the pedestal 1, and consequently the table 7, to be maneuvered for quick and easy transportation. The portable computing device 21 controls the sound system 23 and any other electronic devices that may be connected with the present invention. The portable computing device 21 is preferably a laptop. In alternate embodiments of the present invention, the portable computing device 21 may also be a table 7, smart device, and so on. The power source 22 provides the necessary power for the portable computing device 21 and the sound system 23, whether the portable computing device 21 is a portable 7 battery or a nearby outlet.

The overall arrangement of the aforementioned components provides a compact structure for the present invention and an organized space for DJing equipment. The table 7 is fully supported and evenly balanced with the pedestal 1 as the first elongated casing 2 and the second elongated casing 3 are positioned parallel and offset from each other. This arrangement, seen in FIG. 1, FIG. 2, FIG. 3, FIG. 4, and FIG. 5, also allows electronic connections and electronic devices to be stored within the pedestal 1. The cover 4 is positioned adjacent to the first elongated casing 2 and the second elongated casing 3, concealing the electrical connections and electronic devices stored within the pedestal 1. Moreover, the cover 4 traverses across and along the first elongated casing 2 and the second elongated casing 3. The electronic connections and electronic devices housed within the pedestal 1 are accessible by the user as the door 5 is positioned opposite to the cover 4, across the pedestal 1, and is hingedly connected with the first elongated casing 2. The user is able to perform with the present invention at any location as the table 7 is terminally mounted on the pedestal 1, and the base 8 is terminally connected to the pedestal 1, opposite to the table 7. Furthermore, the portable computing device 21, along with a variety of other DJing equipment, is situated upon the table 7, opposite the pedestal 1. This allows a user to easily access and have constant access to portable computing device 21 and DJing equipment. In order for the portable computing device 21 to manage a variety of electronic devices, the portable computing device 21 is electronically connected with the sound system 23, seen in FIG. 6 and FIG. 8. The electronic devices of the present invention and the electronic devices coupled with the present invention are able to operate as the power source 22 is electrically connected with the portable computing device 21 and the sound system 23, seen in FIG. 7 and FIG. 9.

Figure 2:
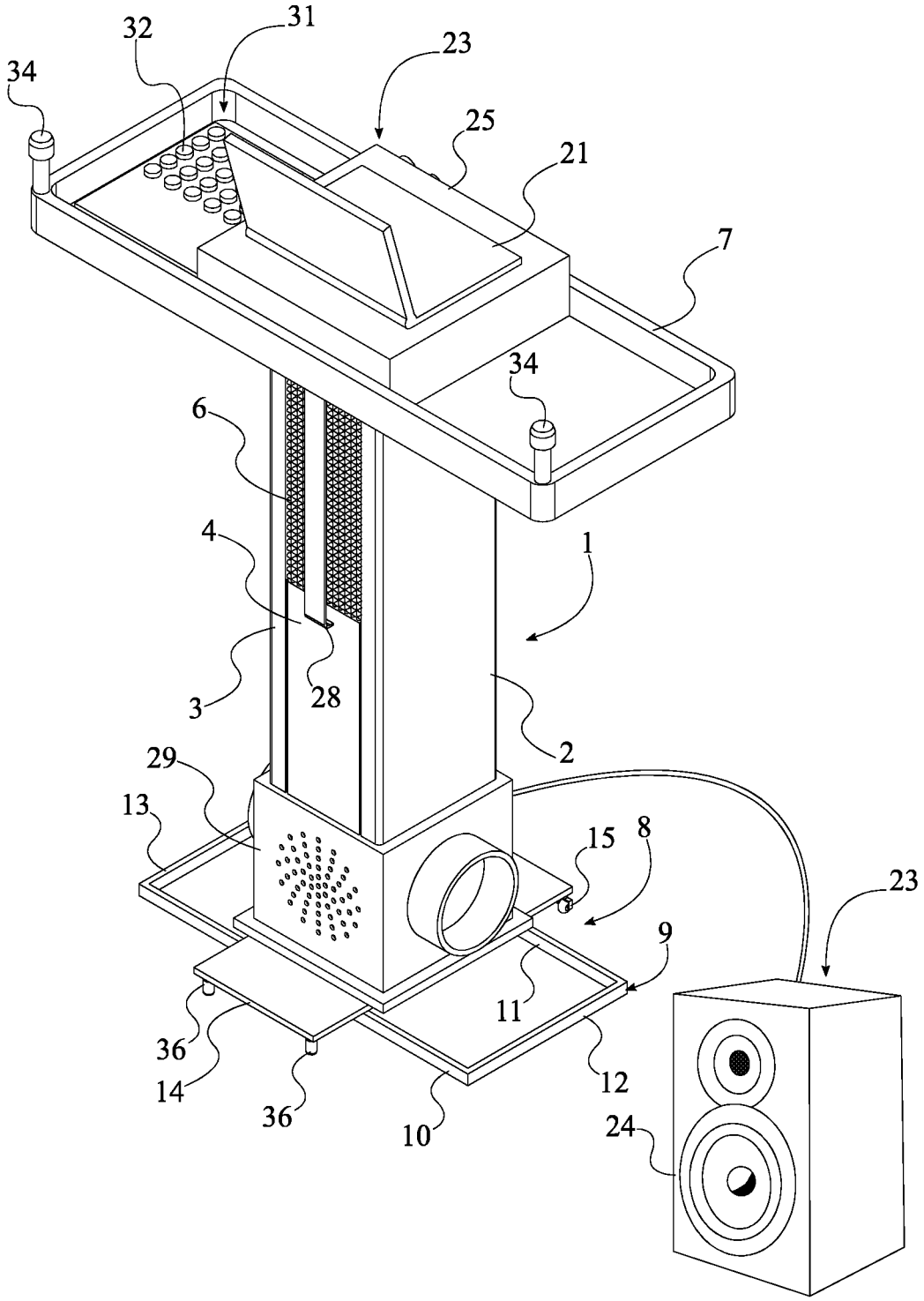
FIG. 2 is a front perspective view of the first embodiment of the present invention connected with at least one speaker.
Figure 3:
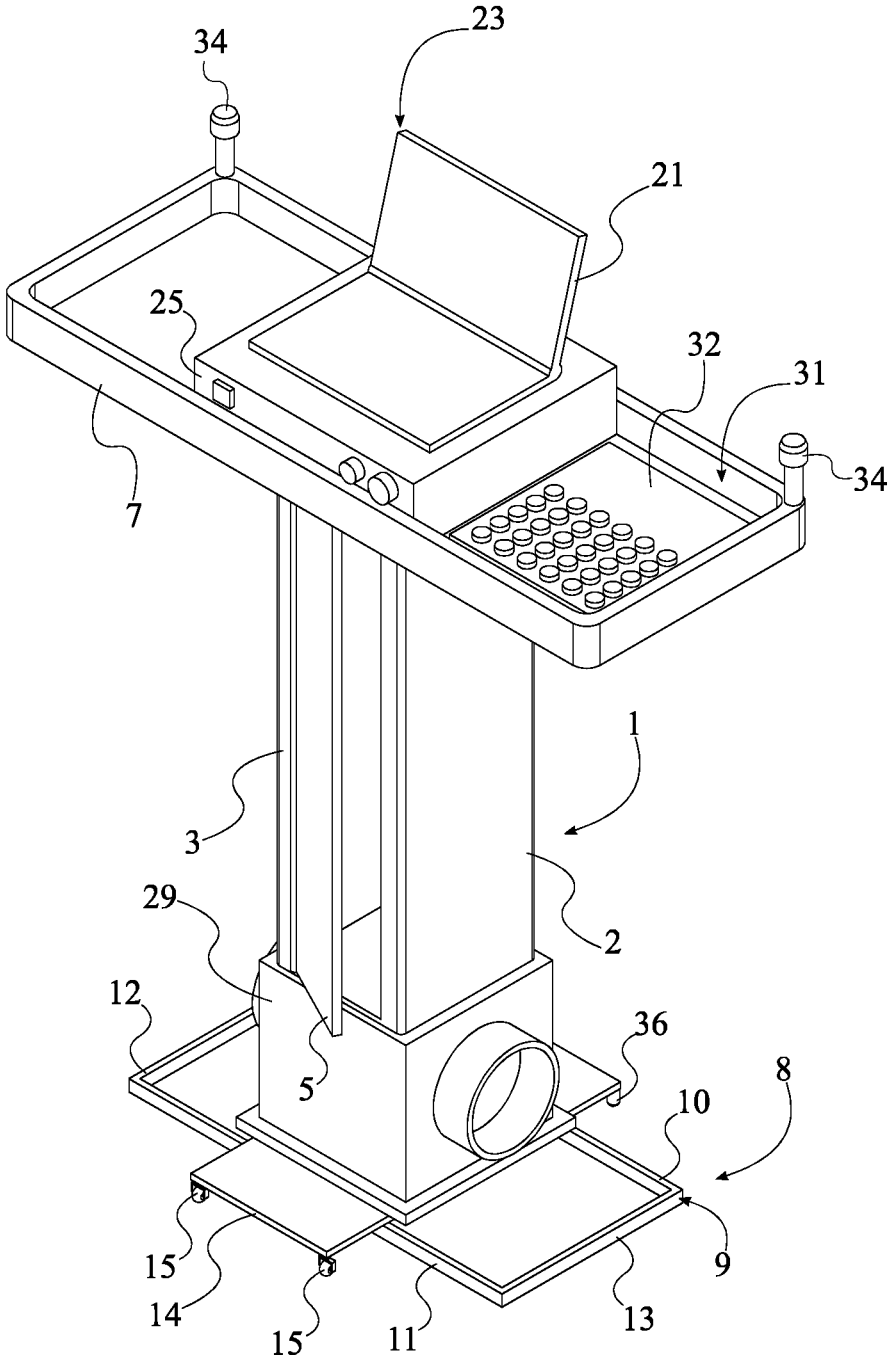
FIG. 3 is a rear perspective view of the first embodiment of the present invention.

In the first embodiment of the present invention, seen in FIG. 1, FIG. 2, and FIG. 3, the present invention is suitable for larger venues and events. The first embodiment typically requires a user to be standing at all times and performing at all times. The pedestal 1 is preferably tall, and the table 7 is preferably separable from the pedestal 1 in this first embodiment. In order for the base 8 to support the pedestal 1 and the table 7 in this embodiment, the base 8 comprises a rectangular stabilizer 9 and a rectangular roller plate 14. The rectangular stabilizer 9 balances the table 7 with the pedestal 1 so that the table 7 does not tilt regardless of the electronic devices resting on the table 7. The rectangular roller plate 14 facilitates the transportation of the present invention and allows the pedestal 1 and the table 7 to slide across the ground. The rectangular stabilizer 9 is mounted onto the rectangular roller plate 14, opposite to the pedestal 1 in order for the rectangular stabilizer 9 to press against the ground and balance the weight distribution of the table 7. In order for the rectangular roller plate 14 to slide across the ground while maintaining the upright orientation of the pedestal 1 with the table 7, the rectangular roller plate 14 and the rectangular stabilizer 9 are positioned perpendicular to each other.

The rectangular stabilizer 9 is structurally sound as the rectangular stabilizer 9 comprises a first lengthwise bar 10, a second lengthwise bat, a first widthwise bar 12, and a second widthwise bar 13, also seen in FIG. 1, FIG. 2, and FIG. 3. The first lengthwise bar 10 and the second lengthwise bar 11 extend across the length of the table 7, stabilizing the table 7 with the pedestal 1. The first widthwise bar 12 and the second widthwise bar 13 connect the first lengthwise bar 10 and the second lengthwise bar 11 with each other in order to preserve the structural integrity of the rectangular stabilizer 9. The first lengthwise bar 10 is positioned adjacent to the first widthwise bar 12 and the second widthwise bar 13. Similarly, the second lengthwise bar 11 is positioned adjacent to the first widthwise bar 12 and the second widthwise bar 13, opposite to the first lengthwise bar 10. The first lengthwise bar 10 and the second lengthwise bar 11 are connected between the first widthwise bar 12 and the second widthwise bar 13, defining a parallel orientation with the first lengthwise bar 10 and the second lengthwise bar 11. This arrangement securely balances the table 7 across the pedestal 1. The rectangular roller plate 14 traverses across the first lengthwise bar 10 and the second lengthwise bar 11. More specifically, the rectangular roller plate 14 is fixed with the first lengthwise bar 10 and the second lengthwise bar 11.

In this first embodiment of the present invention, the base 8 further comprises a couple of casters 15 and a couple of friction-inducing feet 36, seen in FIG. 1, FIG. 2, and FIG. 3. The couple of casters 15 allows the rectangular roller plate 14 may slide across the ground during through transportation. The rectangular plate 14, once stationary, remains stationary with the couple of friction-inducing feet 36 as the couple of friction-inducing feet 36 serve as brakes. The couple of casters 15 is peripherally positioned onto the rectangular roller plate 14, adjacent the door 5 of the pedestal 1, preserving the balance of the base 8 with the table 7. The couple of friction-inducing feet 36 is peripherally positioned onto the rectangular roller plate 14, adjacent the cover 4 of the pedestal 1, further preserving the balance of the base 8 with the table 7. Each of the couple of casters 15 and each of the couple of friction-inducing feet 36 are fixed with the rectangular roller plate 14, opposite to the pedestal 1. The couple of casters 15 and the couple of friction-inducing feet 36 are oriented away from the pedestal 1 in order to come into contact with the ground. Moreover, rectangular stabilizer 9 is positioned in between the couple of casters 15 and the couple of friction-inducing feet 36, evenly distributing the weight of the pedestal 1 and the table 7 with the rectangular stabilizer 9.

The first embodiment of the present invention is further maneuverable as the first embodiment of the present invention comprises a main handlebar 28, shown in FIG. 1 and FIG. 2. The main handlebar 28 allows a user to lift and tilt the pedestal 1 while loading and unloading the present invention from a vehicle or storage unit. The main handlebar 28 is externally positioned to the pedestal 1 and is mounted onto the cover 4. This arrangement creates easy accessibility for a user to grasp the main handlebar 28 while preserving the connection between the main handlebar 28 and the pedestal 1.

A compact structure is maintained as the first embodiment of the present invention further comprises a hub 29, seen in FIG. 1, FIG. 2, and FIG. 3. The hub 29 provides additional storage for electronic connections and electronic devices. In this first embodiment, a stronger and larger power source 22 is required to power the electronic devices connected with the power source 22. The hub 29 therefore houses the power source 22. Furthermore, in this first embodiment of the present invention, the sound system 23 comprises at least one speaker 24, an amplifier 25, and at least one microphone 26. The at least one speaker 24 emits the music as controlled by the portable computing device 21 and input from the microphone, and the amplifier 25 adjusts the sound of the music. The amplifier 25 is preferably a small and digital so that the emission of sound with the at least one speaker 24 is powerful. The at least one microphone 26 allows the user or nearby individuals speaking to be heard within a range of the at least one speaker 24. As the first embodiment is meant to accommodate larger events and larger venues, the at least one speaker 24 is externally positioned to the pedestal 1. This allows the music emitted with the speakers to reach a further range from the pedestal 1. The user may adjust the sound of the music while standing beside the pedestal 1 as the amplifier 25 is positioned adjacent to the table 7, opposite to the pedestal 1. The music selected by the user with the portable computing device 21 is adjusted with the amplifier 25 and emitted with the at least one speaker 24 as the portable computing device 21 is electronically connected with the at least one speaker 24 and amplifier 25. In order for the electrical connections and electronic devices of the first embodiment remains contained and the first embodiment maintains a compact arrangement, the hub 29 is mounted onto the base 8, and the pedestal 1 is mounted onto the hub 29, opposite the base 8. Moreover, the power source 22 is positioned within the hub 29, allowing for the first embodiment to be easily and quickly moved. The portable computing device 21 is communicably coupled with the at least one microphone 26 so that the at least one microphone 26 is not limited in range by the length of a cord. The power source 22 is electrically connected with the at least one speaker 24 and the amplifier 25 in order for the at least one speaker 24 and the amplifier 25 to operate.

Figure 4:
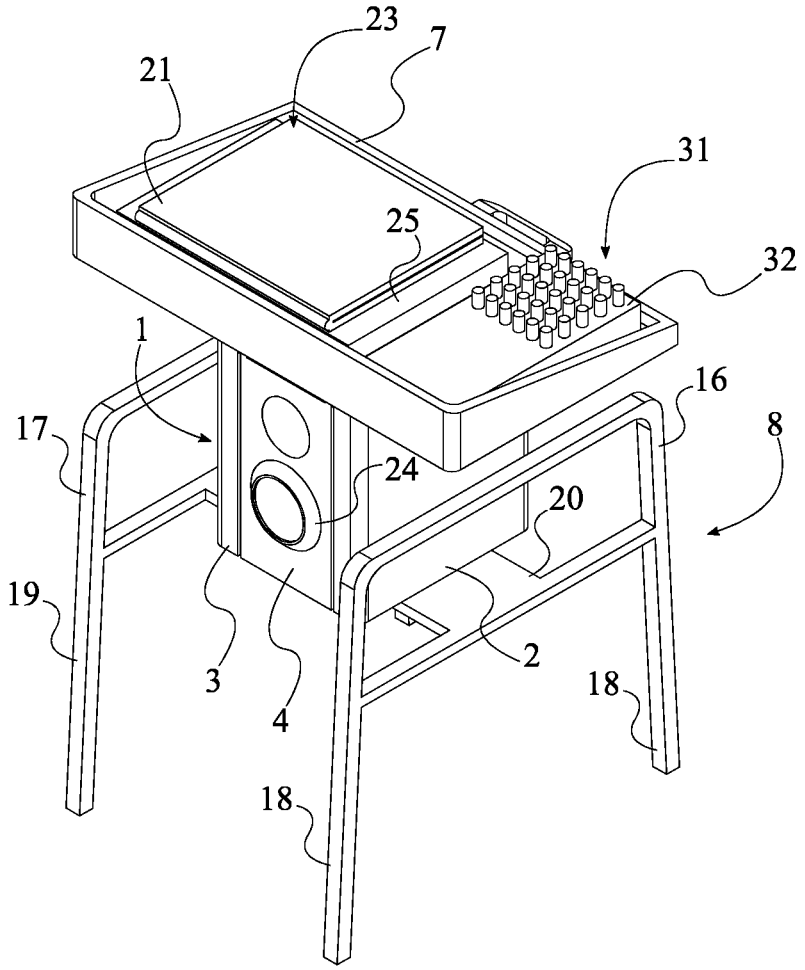
FIG. 4 is a front perspective view of a second embodiment of the present invention.
Figure 5:
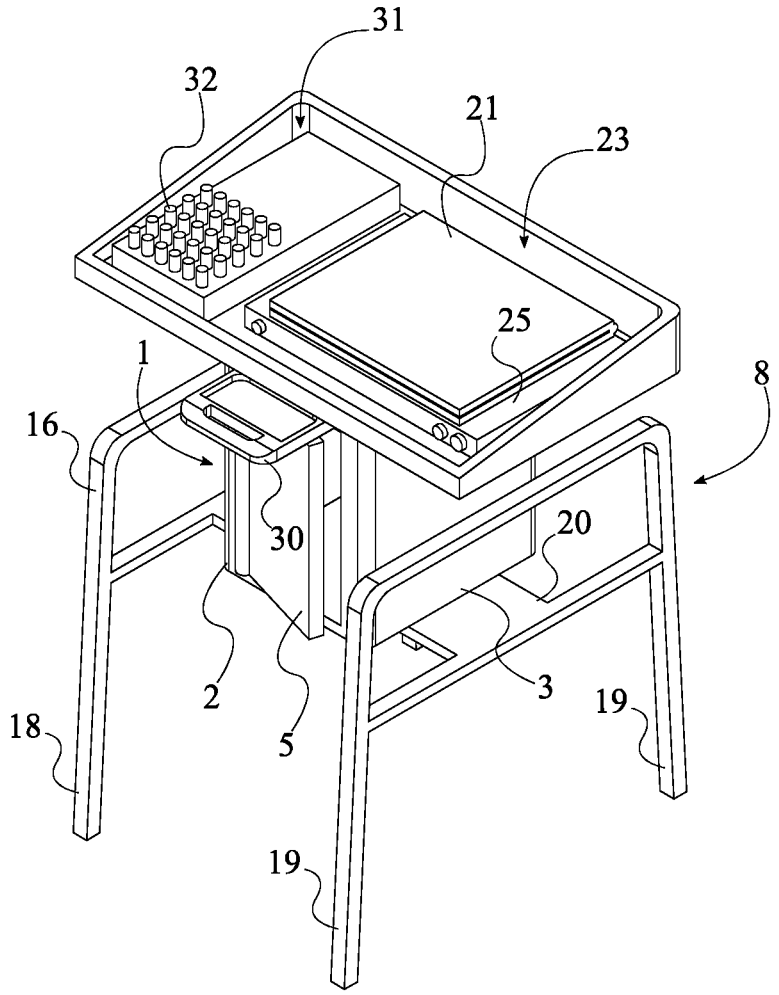
FIG. 5 is a rear perspective view of the second embodiment of the present invention.
Figure 6:
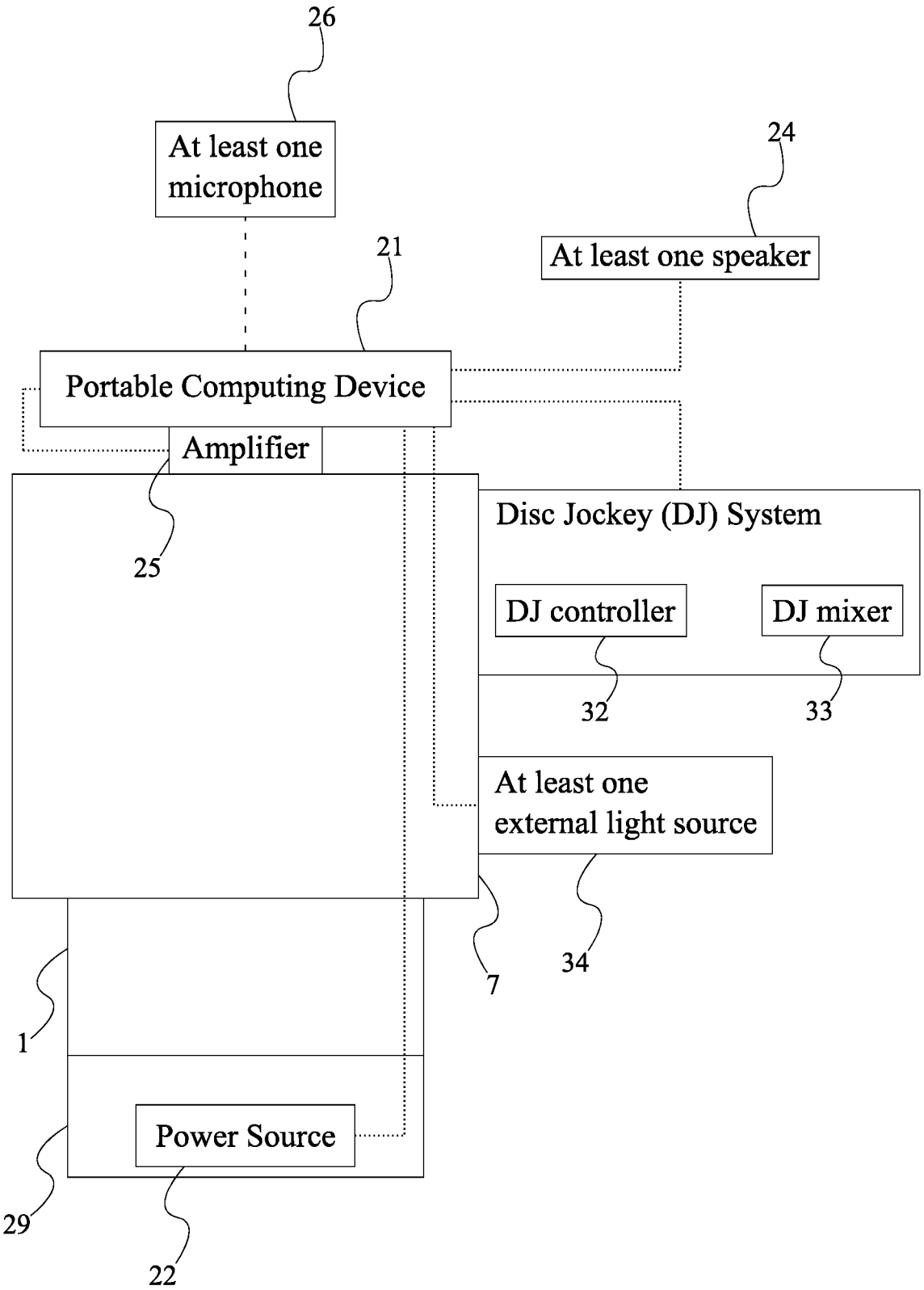
FIG. 6 is a schematic view of electrical connections for the first embodiment of the present invention.
Figure 7:
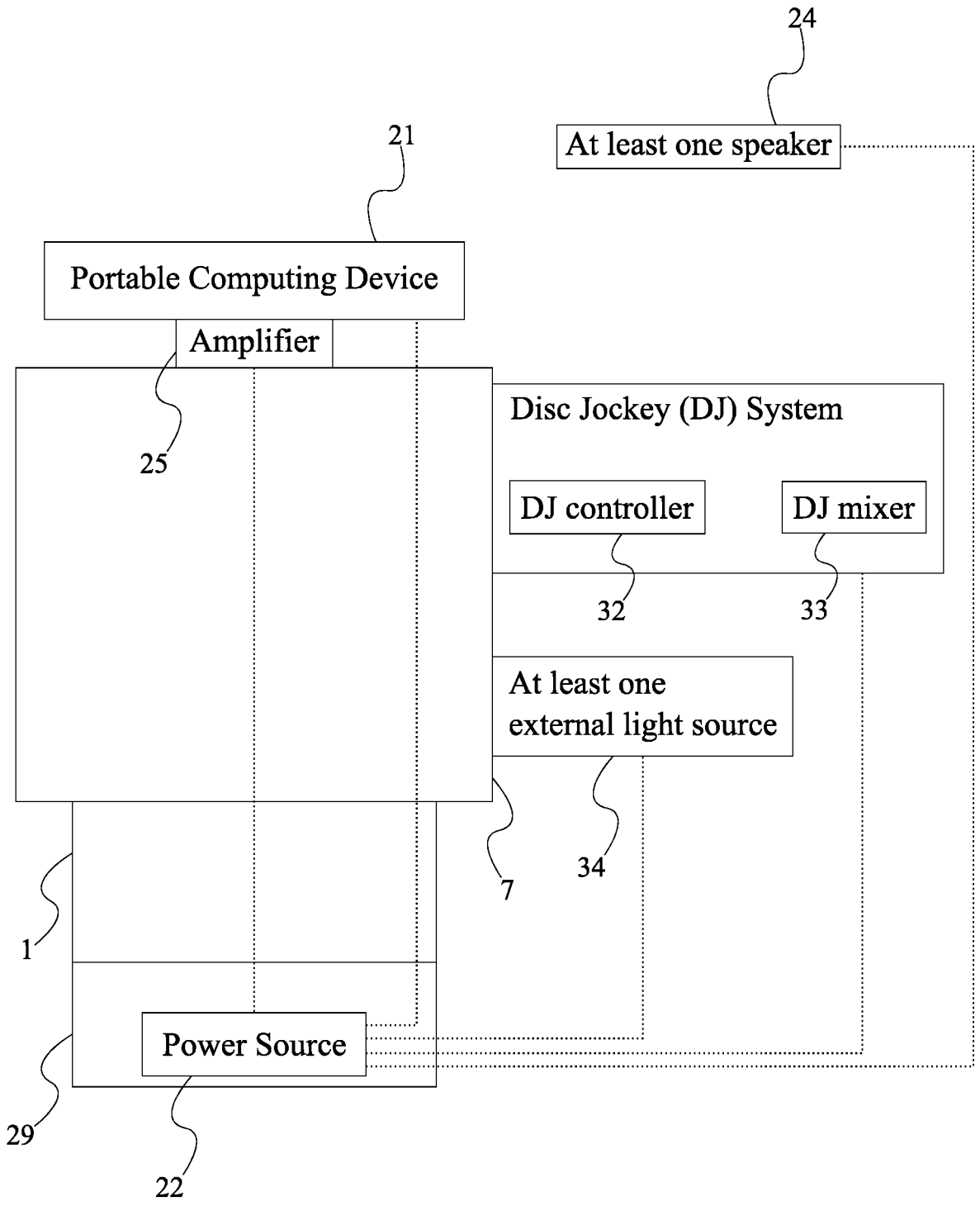
FIG. 7 is a schematic view of the electronic connections for the first embodiment of the present invention.

A second embodiment of the present invention further facilitates the transportation of the present invention as the entire system is contained within the base 8, seen in FIG. 4 and FIG. 5. The base 8 of the second embodiment comprises a first handlebar 16, a second handlebar 17, a pair of first legs 18, a pair of second legs 19, and a cross plate 20. The first handlebar 16 and the second handlebar 17 allow the present invention to be easily lifted. The pair of first legs 18 and the pair of second legs 19 uplifts the pedestal 1 and the table 7 from the ground so that the user may easily engage with the portable computing device 21 and the sound system 23 while standing beside the pedestal 1. The cross plate 20 connects the first handlebar 16 and the second handlebar 17 with each other, as well as suspends the pedestal 1 and the table 7 with the pair of the first legs and the pair of second legs 19. The overall arrangement of the base 8 for the second embodiment of the present invention allows the entire invention to be lifted by the first handlebar 16 and the second handlebar 17 as the cross plate 20 is connected in between the first handlebar 16 and the second handlebar 17. The pair of first legs 18 and the pair of second legs 19 are oriented away from the table 7, suspending the cross plate 20 above the ground. More specifically, the pair of first legs 18 is positioned opposite to each other along the first handlebar 16. In order to facilitate the storage of the second embodiment of the present invention, the pair of first legs 18 is removably attached with the first handlebar 16. Similarly, the pair of second legs 19 is positioned opposite to each other along the second handlebar 17 and is removably attached with the second handlebar 17. The electronic devices housed within the pedestal 1 and the electronic devices resting on the table 7 are secure throughout transportation and secure while in use as the pedestal 1 is mounted normal onto the cross plate 20.

Figure 8:
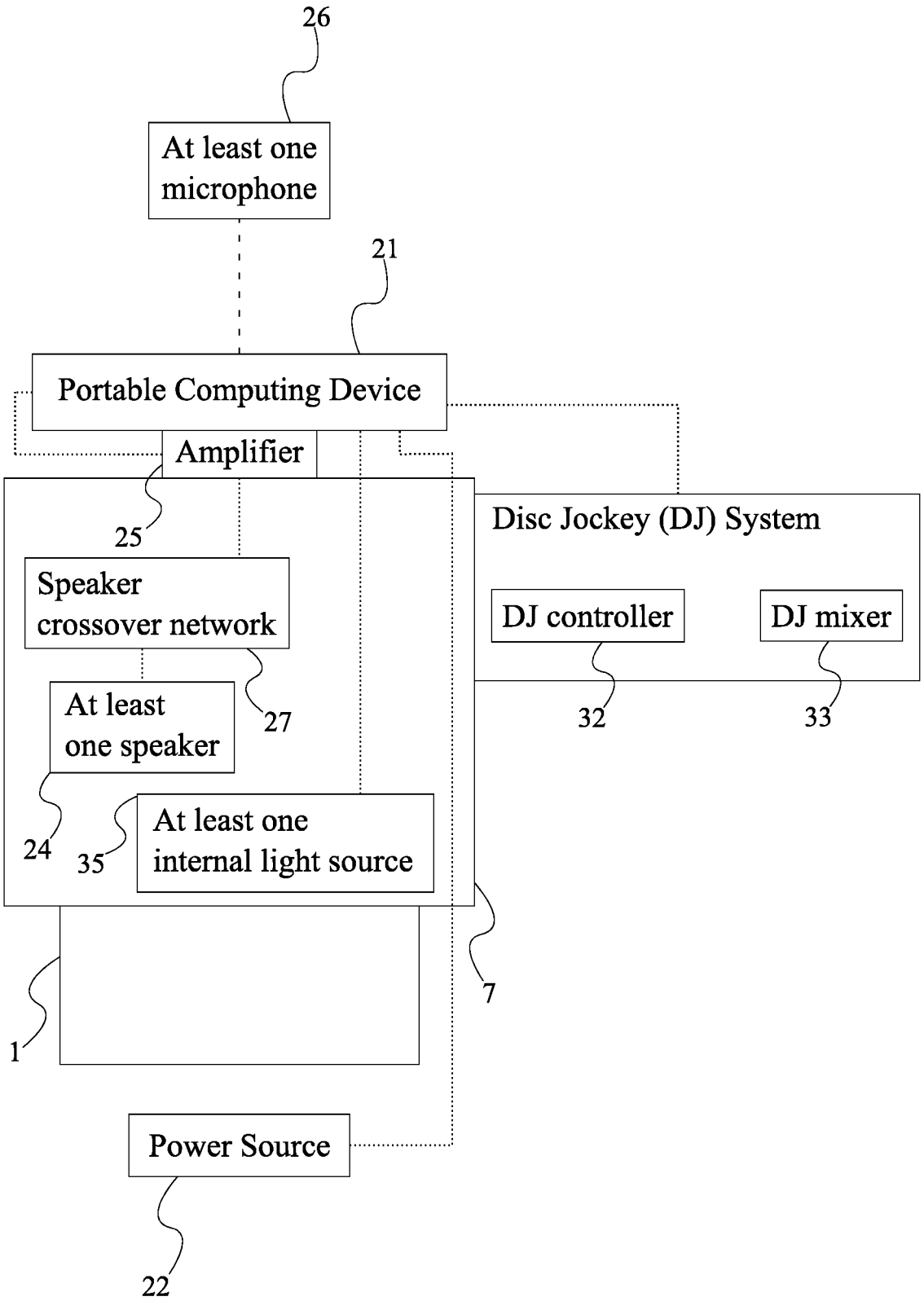
FIG. 8 is a schematic view of electrical connections for the second embodiment of the present invention.
Figure 9:
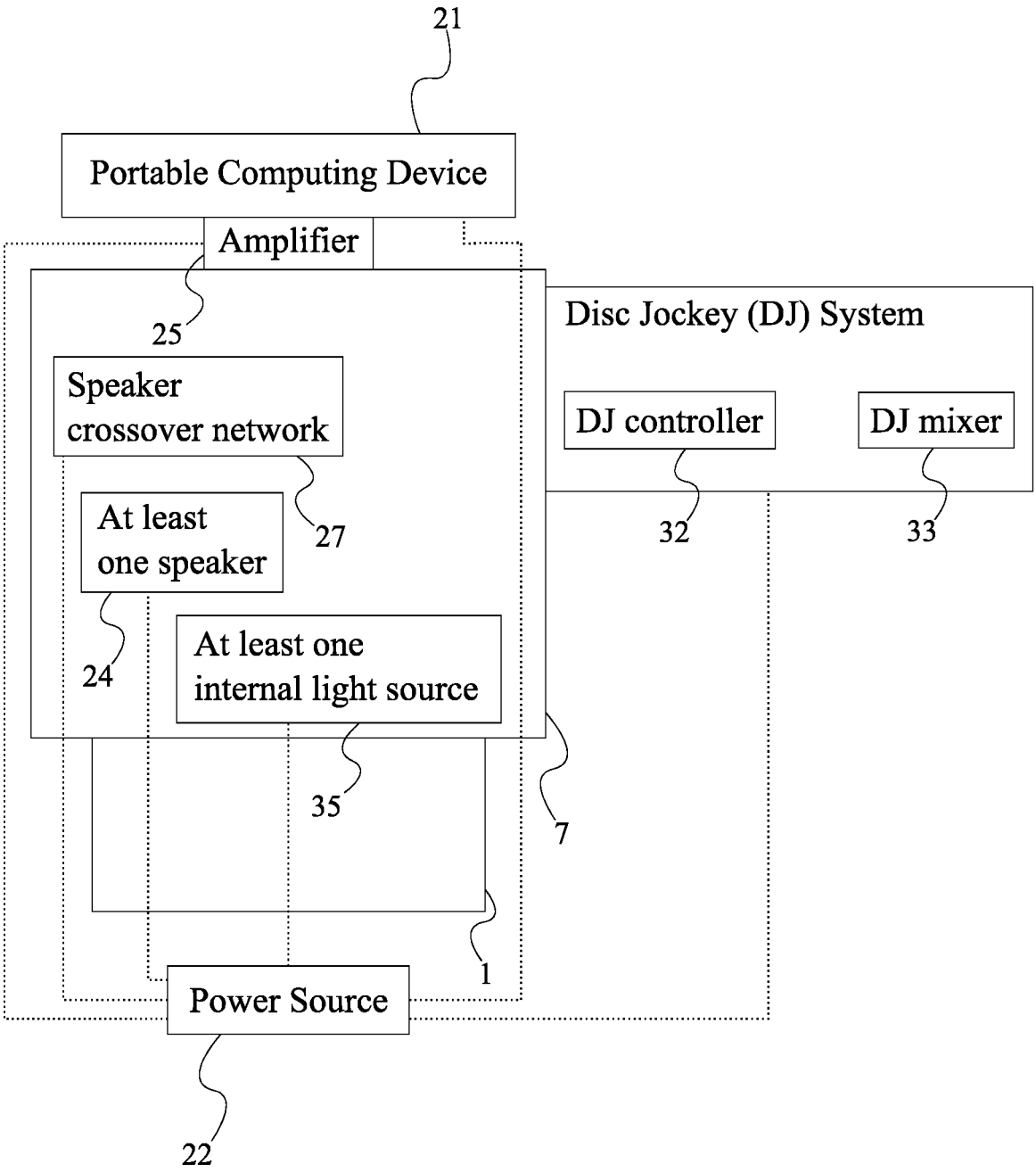
FIG. 9 is a schematic view of the electronic connections for the second embodiment of the present invention.

In this second embodiment of the present invention, the sound system 23 further comprises a speaker crossover network 27, seen in FIG. 8 and FIG. 9. The sound system 23 of the second embodiment of the present invention also comprises at least one speaker 24, an amplifier 25, and at least one microphone 26 like that of the first embodiment of the present invention. The at least one speaker 24 is integrated into the cover 4 of the pedestal 1, preserving the compact structure of the second embodiment of the present invention. Similar to the first embodiment of the present invention, the amplifier 25 is positioned adjacent to the table 7, opposite to the pedestal 1. The power source 22 is externally positioned to the pedestal 1 and is connected with the present invention via a power cord. This arrangement allows the overall weight of the present invention to remain relatively light for quick and easy transport. In order to utilize the pedestal 1 as a speaker, the speaker crossover network 27 is electronically connected with the speaker crossover network 27 and the amplifier 25. Similar with the first embodiment of the present invention, the portable computing device 21 is electronically connected with the at least one speaker 24, the speaker crossover network 27, and the amplifier 25 and is communicably coupled with the at least one microphone 26. Moreover, the power source 22 is electrically connected with the at least one speaker 24, the speaker crossover network 27, and the amplifier 25.

As the overall size of the table 7 for the second embodiment of the present invention may not be large enough to uphold a variety of DJing equipment and electronic devices, the second embodiment of the present invention further comprises a tray 30, seen in FIG. 5. The tray 30 preferably contains a mouse for the portable computing device 21 or a variety of other controller devices. The tray 30 is positioned between the door 5 and the table 7 and is parallel with the table 7. More specifically, the tray 30 is positioned between the first elongated casing 2 and the second elongated casing 3. The tray 30 is both easily accessible and is quickly stored within the pedestal 1 as the tray 30 is slidably mounted with the first elongated casing 2 and the second elongated casing 3.

In order to further enhance the sound of the music with present invention, the present invention further comprises a disc jockey (DJ) system 31. The DJ system 31 preferably comprises a DJ controller 32 and a DJ mixer 33, seen in FIG. 6, FIG. 7, FIG. 8, and FIG. 9. The DJ controller 32 allows a user to simulate the sounds of a traditional DJ turntables with the portable computing device 21. The DJ mixer 33 allows the user to manipulate the music played with the portable computing device 21 in order to create a seamless stream of music for the duration of an event. The DJ controller 32 and the DJ mixer 33 are positioned adjacent to the table 7, opposite to the pedestal 1. This arrangement allows both the DJ controller 32 and the DJ mixer 33 to be readily accessible throughout the performance of the user. In order to process the and manipulate the music the portable computing device 21 is electronically connected with the DJ controller 32 and DJ mixer 33.

The present invention enhances the overall ambiance of the surrounding environment as the DJ system 31 further comprises at least one external light source 34, seen in FIG. 1, FIG. 2, and FIG. 3. The at least one external light source 34 is mounted adjacent to the table 7, opposite to the pedestal 1. The portable computing device 21 is electronically connected with the at least one external light source 34 in order for the user to control the at least one external light source 34. This arrangement allows the at least one external light source 34 to flash with the music played with the portable computing device 21. The at least one external light source 34 is able to operate as the power source 22 is electrically connected with the at least one external light source 34. Alternate embodiments of the present invention may further comprise at least one internal light source 35. In order for the at least one internal light source 35 to be visible from the surrounding environment, the pedestal 1 further comprises a grille 6. The grille 6 is preferably integrated into the cover 4 and the at least one internal light source 35 is mounted within the pedestal 1. Moreover, the at least one internal light source 35 is oriented towards the grille 6. Similar with the at least one external light source 34, the portable computing device 21 is electronically connected with the at least one internal light source 35, and the power source 22 is electrically connected with the at least one internal light source 35.

Although the invention has been explained in relation to its preferred embodiment, it is to be understood that many other possible modifications and variations can be made without departing from the spirit and scope of the invention as hereinafter claimed.

What is claimed is:

1. A portable disc jockey sound system comprises:

a pedestal;

a table;

a base;

a portable computing device;

a power source;

a sound system;

the pedestal comprises a first elongated casing, a second elongated casing, a cover, and a door;

the first elongated casing and the second elongated casing being positioned parallel and offset from each other;

the cover being positioned adjacent to the first elongated casing and the second elongated casing;

the cover traversing across and along the first elongated casing and the second elongated casing;

the door being positioned opposite to the cover, across the pedestal;

the door being hingedly connected with the first elongated casing;

the table being terminally mounted to the pedestal;

the base being terminally connected to the pedestal, opposite to the table;

the portable computing device being situated upon the table, opposite to the pedestal;

the portable computing device being electronically connected with the sound system;

the power source being electrically connected with the portable computing device and the sound system;

the base comprises a rectangular stabilizer and a rectangular roller plate;

the pedestal being mounted normal onto the rectangular roller plate;

the rectangular stabilizer being mounted onto rectangular roller plate, opposite to the pedestal; and, the rectangular roller plate and the rectangular stabilizer being positioned perpendicular to each other.

2. The portable disc jockey sound system as claimed in claim 1 comprises:

the rectangular stabilizer comprises a first lengthwise bar, a second lengthwise bar, a first widthwise bar, and a second widthwise bar;

the first lengthwise bar being positioned adjacent to the first widthwise bar and the second widthwise bar;

the second lengthwise bar being positioned adjacent to the first widthwise bar and the second widthwise bar, opposite to the first lengthwise bar;

the first lengthwise bar and the second lengthwise bar being connected between the first widthwise bar and the second widthwise bar;

the rectangular roller plate traversing across the first lengthwise bar and the second lengthwise bar; and, the rectangular roller plate being fixed with the first lengthwise bar and the second lengthwise bar.

3. The portable disc jockey sound system as claimed in claim 1 comprises:

the base further comprises a couple of casters and a couple of friction-inducing feet;

the couple of casters being peripherally positioned onto the rectangular roller plate, adjacent the door of the pedestal;

the couple of friction-inducing feet being peripherally positioned onto the rectangular roller plate, adjacent the cover of the pedestal;

each of the couple of casters and each of the couple of friction-inducing feet being fixed with the rectangular roller plate, opposite to the pedestal;

the couple of casters and the couple of friction-inducing feet being oriented away from the pedestal; and, the rectangular stabilizer being positioned in between the couple of casters and the couple of friction-inducing feet.

4. The portable disc jockey sound system as claimed in claim 1 comprises:

a main handlebar;

the main handlebar being externally positioned to the pedestal; and, the main handlebar being mounted onto the cover.

5. The portable disc jockey sound system as claimed in claim 1 comprises:

a hub;

the sound system comprises at least one speaker, an amplifier, and at least one microphone;

the at least one speaker being externally positioned to the pedestal;

the amplifier being positioned adjacent to the table, opposite to the pedestal;

the portable computing device being electronically connected with the at least one speaker and the amplifier;

the hub being mounted onto the base;

the pedestal being mounted onto the hub, opposite the base;

the power source being positioned within the hub;

the portable computing device being communicably coupled with the at least one microphone; and, the power source being electrically connected with the at least one speaker and the amplifier.

6. The portable disc jockey sound system as claimed in claim 1 comprises:

the base comprises a first handlebar, a second handlebar, a pair of first legs, a pair of second legs, and a cross plate;

the first handlebar being positioned opposite to the second handlebar across the cross plate;

the cross plate being connected in between the first handlebar and the second handlebar;

the pair of first legs and the pair of second legs being oriented away from the table;

the pair of first legs being positioned opposite to each other along the first handlebar;

the pair of first legs being removably attached with first handlebar;

the pair of second legs being positioned opposite to each other along the second handlebar;

the pair of second legs being removably attached with the second handlebar; and, the pedestal being mounted normal onto the cross plate.

7. The portable disc jockey sound system as claimed in claim 1 comprises:

a sound system;

the sound system comprises at least one speaker, a speaker crossover network, an amplifier, and at least one microphone;

the at least one speaker being integrated into the cover of the pedestal;

the speaker crossover network being positioned within the pedestal;

the amplifier being positioned adjacent to the table, opposite to the pedestal;

the power source being externally positioned to the pedestal;

the speaker crossover network being electronically connected with the at least one speaker and the amplifier;

the portable computing device being electronically connected with at least one speaker, the speaker crossover network, and the amplifier;

the portable computing device being communicably coupled with the at least one microphone; and, the power source being electrically connected with the at least one speaker, the speaker crossover network, and the amplifier.

8. The portable disc jockey sound system as claimed in claim 1 comprises:

a tray;

the tray being positioned between the door and the table;

the tray being positioned parallel with the table;

the tray being positioned between the first elongated casing and the second elongated casing; and, the tray being slidably mounted with the first elongated casing and the second elongated casing.

9. The portable disc jockey sound system as claimed in claim 1 comprises:

a disc jockey (DJ) system;

the disc jockey system comprises a DJ controller and a DJ mixer;

the DJ controller and the DJ mixer being positioned adjacent to the table, opposite to the pedestal; and, the portable computing device being electronically connected with the DJ controller and the DJ mixer.

10. The portable disc jockey sound system as claimed in claim 9 comprises:

the disc jockey system further comprises at least one external light source;

the at least one external light source being mounted adjacent to the table, opposite to the pedestal;

the portable computing device being electronically connected with the at least one external light source; and, the power source being electrically connected with the at least one external light source.

11. The portable disc jockey sound system as claimed in claim 9 comprises:

the disc jockey system further comprises at least one internal light source;

the pedestal further comprises a grille;

the grille being integrated into the cover;

the at least one internal light source being mounted within the pedestal;

the at least one internal light source being oriented towards the grille;

the portable computing device being electronically connected with the at least one internal light source; and, the power source being electrically connected with the at least one internal light source.

* * * * *